US006981653B2

(12) United States Patent
Boehland

(10) Patent No.: US 6,981,653 B2
(45) Date of Patent: Jan. 3, 2006

(54) FUEL INJECTION DEVICE FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/474,339

(22) PCT Filed: Dec. 5, 2002

(86) PCT No.: PCT/DE02/04455

§ 371 (c)(1),
(2), (4) Date: Apr. 12, 2004

(87) PCT Pub. No.: WO03/067070

PCT Pub. Date: Aug. 14, 2003

(65) Prior Publication Data

US 2004/0169092 A1 Sep. 2, 2004

(30) Foreign Application Priority Data

Feb. 8, 2002 (DE) ..... 102 05 185

(51) Int. Cl.
*F02M 47/02* (2006.01)

(52) U.S. Cl. ..... 239/88; 239/89; 239/91; 239/92; 239/124; 123/467; 123/446

(58) Field of Classification Search ..... 239/88, 239/89, 90, 91, 124, 533.2, 533.3, 533.4, 239/92, 585.1; 123/467, 446, 447, 498
See application file for complete search history.

(56) References Cited

U.S. PATENT DOCUMENTS

| | | | | |
|---|---|---|---|---|
| 5,860,597 | A | 1/1999 | Tarr | |
| 6,021,760 | A * | 2/2000 | Boecking | 123/467 |
| 6,405,941 | B2 | 6/2002 | Ganser | |
| 6,499,465 | B1 * | 12/2002 | Mahr et al. | 123/447 |

FOREIGN PATENT DOCUMENTS

| | | |
|---|---|---|
| DE | 199 46 766 A1 | 4/2001 |
| EP | 0 987 431 A2 | 3/2000 |
| WO | WO 00/28205 A1 | 5/2000 |

* cited by examiner

*Primary Examiner*—Dinh Q. Nguyen
(74) *Attorney, Agent, or Firm*—Ronald E. Greigg

(57) ABSTRACT

A fuel injection system having a high-pressure fuel pump connected to a fuel injection valve for each cylinder of an internal combustion engine in which the high-pressure fuel pump has a piston defining a working chamber communicating with a pressure chamber of the fuel injection valve, which has an injection valve element that controls injection openings and can be moved in an opening direction counter to a closing force by the pressure prevailing in the pressure chamber. A first control valve controls a connection of the pump working chamber to a relief chamber and a second control valve controls a connection of a control pressure chamber, which communicates with the pump working chamber, to a relief chamber. When a control piston acts on the injection valve element, in a stroke position of the control piston in which the injection valve element is in its closed position, the pressure prevailing in the control pressure chamber acts on a greater end surface of the control piston than in a stroke position of the control piston in which the injection valve element is opened by its maximal stroke.

20 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 02/04455 filed on Dec. 5, 2002.

BACKGROUND OF THE INVENTION

1. Field of the Invention

The invention is directed to an improved fuel injection system for an internal combustion engine and more particularly to such a system having a high pressure pump connected to a fuel injection valve for each cylinder of the engine.

The invention is based on a fuel injection system for an internal combustion engine as generically defined by the preamble to claim 1.

2. Description of the Prior Art

A fuel injection system known from EP 0 987 431 A2 has a high-pressure fuel pump that is connected to a fuel injection valve for each cylinder of the internal combustion engine. The high-pressure fuel pump has a pump piston that defines a pump working chamber and is driven into a stroke motion by the engine. The fuel injection valve has a pressure chamber connected to the pump working chamber and an injection valve element that controls at least one injection opening; the pressure prevailing in the pressure chamber can move the injection valve element in the opening direction counter to a closing force in order to open the at least one injection opening. A first electrically actuated control valve controls a connection of the pump working chamber to a relief chamber. A second electrically actuated control valve controls a connection of a control pressure chamber to a relief chamber. A control piston defines the control pressure chamber; the pressure prevailing in the control pressure chamber causes the control piston to act on the injection valve element in a closing direction and this control piston can move in concert with the injection valve element. The control pressure chamber has a connection to the pump working chamber. For a fuel injection, the first control valve is closed and the second control valve is opened so that high pressure cannot build up in the control pressure chamber and the fuel injection valve can open. When the second control valve is open, though, fuel flows out of the pump working chamber via the control pressure chamber so that the fuel quantity available for the injection is reduced along with the fuel quantity supplied by the pump piston and the pressure available for the injection is reduced as well. It follows from this that the efficiency of the fuel injection system is not optimal.

A fuel injection system of this kind is known from EP 0 987 431 A2. This fuel injection system has a high-pressure fuel pump that is connected to a fuel injection valve for each cylinder of the internal combustion engine. The high-pressure fuel pump has a pump piston that defines a pump working chamber and is driven into a stroke motion by the engine. The fuel injection valve has a pressure chamber connected to the pump working chamber and an injection valve element that controls at least one injection opening; the pressure prevailing in the pressure chamber can move the injection valve element in the opening direction counter to a closing force in order to open the at least one injection opening. A first electrically actuated control valve is provided, which controls a connection of the pump working chamber to a relief chamber. A second electrically actuated control valve is also provided, which controls a connection of a control pressure chamber to a relief chamber. A control piston defines the control pressure chamber; the pressure prevailing in the control pressure chamber causes the control piston to act on the injection valve element in a closing direction and this control piston can move in concert with the injection valve element. The control pressure chamber has a connection to the pump working chamber. For a fuel injection, the first control valve is closed and the second control valve is opened so that high pressure cannot build up in the control pressure chamber and the fuel injection valve can open. When the second control valve is open, though, fuel flows out of the pump working chamber via the control pressure chamber so that the fuel quantity available for the injection is reduced along with the fuel quantity supplied by the pump piston and the pressure available for the injection is reduced as well. It follows from this that the efficiency of the fuel injection system is not optimal.

SUMMARY AND ADVANTAGES OF THE INVENTION

The fuel injection system according to the invention has the advantage over the prior art that when the injection valve element is in its open position, a smaller area of the control piston is acted on by the pressure prevailing in the control pressure chamber and consequently a weaker force acts on the injection valve element in the closing direction than when the injection valve element is in its closed position so that the second control valve can be closed during the fuel injection and no loss in fuel quantity or fuel pressure occurs during the injection, which therefore improves the efficiency of the fuel injection system.

Advantageous embodiments and modifications of the fuel injection system according to the invention are disclosed. One embodiment permits the pressure-exposed end surface of the control piston to be reduced in a simple way.

The fuel injection system according to the invention, with the characterizing features of claim 1, has the advantage over the prior art that when the injection valve element is in its open position, a smaller area of the control piston is acted on by the pressure prevailing in the control pressure chamber and consequently a weaker force acts on the injection valve element in the closing direction than when the injection valve element is in its closed position so that the second control valve can be closed during the fuel injection and no loss in fuel quantity or fuel pressure occurs during the injection, which therefore improves the efficiency of the fuel injection system.

Advantageous embodiments and modifications of the fuel injection system according to the invention are disclosed in the dependent claims. The embodiment according to claim 2 permits the pressure-exposed end surface of the control piston to be reduced in a simple way.

BRIEF DESCRIPTION OF THE DRAWINGS

Exemplary embodiments of the invention are described herein below, with reference to the drawings, in which.

DESCRIPTION OF THE PREFERRED EMBODIMENT

Figure 1:
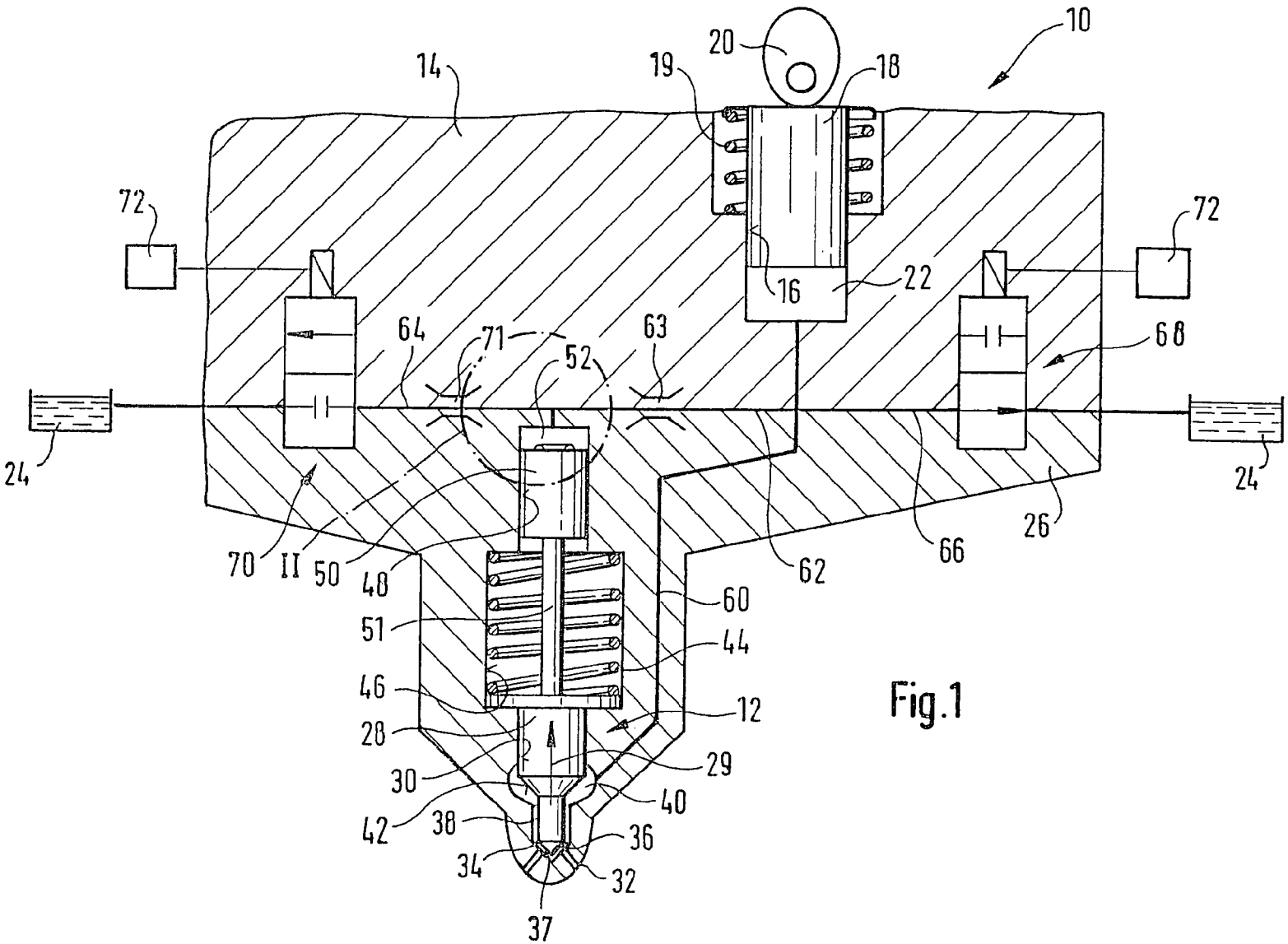
FIG. 1 schematically depicts a fuel injection system for an internal combustion engine according to the invention.

FIGS. 1 to 5 show a fuel injection system for an internal combustion engine of a motor vehicle, preferably an autoignition engine in which the fuel injection system is preferably embodied as a so-called unit fuel injector and, for each cylinder of the engine, has a high-pressure fuel pump 10 and a fuel injection valve 12 connected to it, which comprise a common component. Alternatively, the fuel injection system can also be embodied as a so-called unit pump system, in which the high-pressure fuel pump and the fuel injection valve of each cylinder are disposed separate from each other and are connected to each other via a line. The high-pressure fuel pump 10 has a pump body 14 with a cylinder bore 16 in which a pump piston 18 is guided in a sealed fashion, which piston is set into a stroke motion counter the force of a return spring 19, at least indirectly by means of a cam 20 of a camshaft of the engine. In the cylinder bore 16, the pump piston 18 defines a pump working chamber 22 in which fuel is compressed at high pressure during the delivery stroke of the pump piston 18. The pump working chamber 22 is supplied with fuel from a fuel tank 24 of the motor vehicle.

The fuel injection valve 12 has a valve body 26 that is connected to the pump body 14 and can be composed of a number of parts; an injection valve element 28 can be guided in a bore 30 in this valve body 26. In its end region oriented toward the combustion chamber of the cylinder of the engine, the valve body 26 has at least one, preferably several injection openings 32. In its end region oriented toward the combustion chamber, the injection valve element 28 has a sealing surface 34 that is conical, for example, which cooperates with a valve seat 36 embodied in the end region of the valve body 26 oriented toward the combustion chamber; the injection openings 32 branch off from this valve seat 26 or branch off downstream of it. In the valve body 26, between the injection valve element 28 and the bore 30, toward the valve seat 36, there is an annular space 38, which in its end region oriented away from the valve seat 36, by means of a radial enlargement of the bore 30, transitions into a pressure chamber 40 that encompasses the injection valve element 28. At the level of the pressure chamber 40, the fuel injection valve 28 has a pressure shoulder 42 formed by a cross sectional reduction. The end of the injection valve element 28 oriented away from the combustion chamber is engaged by a prestressed closing spring 44, which presses the injection valve element 28 toward the valve seat 36. The closing spring 44 is disposed in a spring chamber 46 of the valve body 26, which adjoins the bore 30.

At its end oriented away from the bore 30, the spring chamber 46 is adjoined by an additional bore 48 in the valve body 26, in which a control piston 50 is guided in a sealed fashion, which is connected to the injection valve element 28. The control piston 50 functions as a moving wall to define a control pressure chamber 52 in the bore 48. The control piston 50 is connected to the injection valve element 28 by means of a piston rod 51 with a diameter smaller than that of the control piston. The control piston 50 can be of one piece with the injection valve element 28, but for assembly reasons is preferably embodied as a separate part that is attached to the injection valve element 28.

A conduit 60 leads from the pump working chamber 22, through the pump body 14 and the valve body 26 to the pressure chamber 40 of the fuel injection valve 12. A conduit 62 leads from the pump working chamber 22 or from the conduit 60, to the control pressure chamber 52. The control pressure chamber 52 is also fed by a conduit 64, which produces a connection to a relief chamber, which function can be served at least indirectly by the fuel tank 24 or another region in which a low pressure prevails. A connection 66 leads from the pump working chamber 22 or the conduit 60 to a relief chamber 24 and is controlled by means of a first electrically actuated control valve 68. The control valve 68 can, as shown in FIG. 1, be embodied as a 2/2-port directional control valve. The connection 64 of the control pressure chamber 52 to the relief chamber 24 is controlled by a second electrically actuated control valve 70, which can be embodied as a 2/2-port directional control valve. A throttle restriction 63 can be provided in the connection 62 of the control pressure chamber 52 to the pump working chamber 22 and a throttle restriction 71 can be provided in the connection of the control pressure chamber 52 to the relief chamber 24. The control valves 68, 70 can have an electromagnetic actuator or a piezoelectric actuator and are triggered by an electronic control unit 72.

When the fuel injection valve 12 is closed, then the annular sealing surface 34 of the injection valve element 28 rests against the valve seat 36. In this case, only the surface area of the pressure shoulder 42 of the injection valve element 28 is acted on in the opening direction 29 by the pressure prevailing in the pressure chamber 40 and no other forces act on the injection valve element 28 in the opening direction 29. When the fuel injection valve 12 opens, then the sealing surface 34 of the injection valve element 28 lifts up from the valve seat 36 thus opening an annular flow cross section 37 between the sealing surface 34 and the valve seat 36. When the sealing surface 34 of the injection valve element 28 is lifted up from the valve seat 36, then a pressure likewise acts on the end surface of the injection valve element 28, i.e. the annular sealing surface 34 and the remaining surface area of the injection valve element 28 surrounded by this sealing surface 34, thus exerting a force on the injection valve element 28 in the opening direction 29. When the sealing surface 34 of the injection valve element 28 is spaced only a small distance apart from the valve seat 36 and is consequently only opened by a partial stroke, then only a small flow cross section 37 is opened, which throttles the fuel flowing through, resulting in a pressure drop. Then the only force acting on the end surface of the injection valve element 28 in the opening direction is the pressure that is reduced by the throttling action in comparison to the pressure prevailing in the pressure chamber 40. When the injection valve element 28 executes its maximal opening stroke, then its sealing surface 34 is spaced a greater distance apart from the valve seat 36 so that a correspondingly greater flow cross section 37 is opened. With the greater flow cross section, a less intense throttling action occurs so that a correspondingly higher pressure acts on the end surface of the injection valve element 28 in the opening direction 29. When the fuel injection valve 12 is open, the injection valve element 28 is consequently also acted on with the force exerted in the opening direction 29 by the pressure acting on the end surface of the injection valve element 28 in addition to the force exerted on the pressure shoulder 42 by the pressure prevailing in the pressure chamber 40.

The end surface of the control piston 50 that is acted on by the pressure prevailing in the control pressure chamber 52 is sized so that when the second control valve 70 is closed, when the control pressure chamber 52 is closed off from the relief chamber 24, and during the delivery stroke of the pump piston 18, high pressure builds up in the pump working chamber 22 and therefore also in the control pressure chamber 52 and, in addition to the force of the closing spring 44, a force acting on the injection valve element 28 in the closing direction is produced, which is greater than the force acting on the injection valve element 28 in the opening direction 29 when the injection valve element 28 is in its closed position or, as explained above, is opened with only a partial stroke and its sealing surface 34 is lifted up from the valve seat 36. In this case, the fuel injection valve 12 is closed or remains closed.

Figure 2:
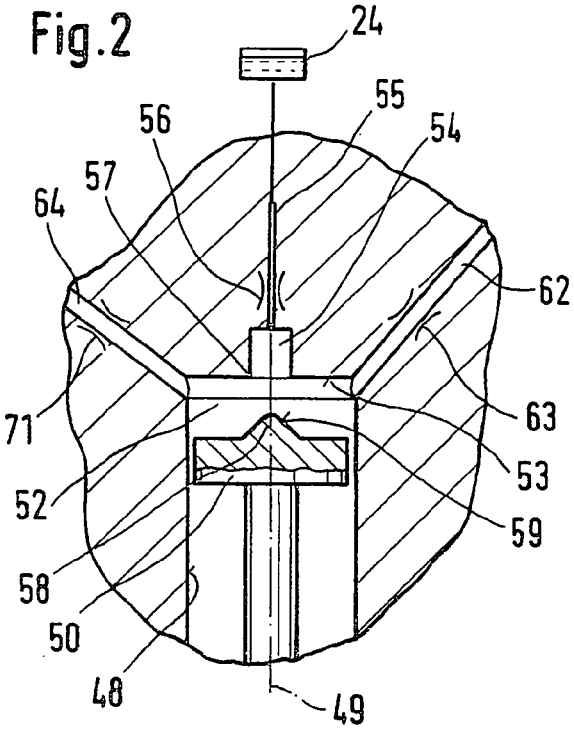
FIG. 2 shows an enlarged detail, labeled II in FIG. 1, of the fuel injection system when an injection valve element is in a closed position.
Figure 3:
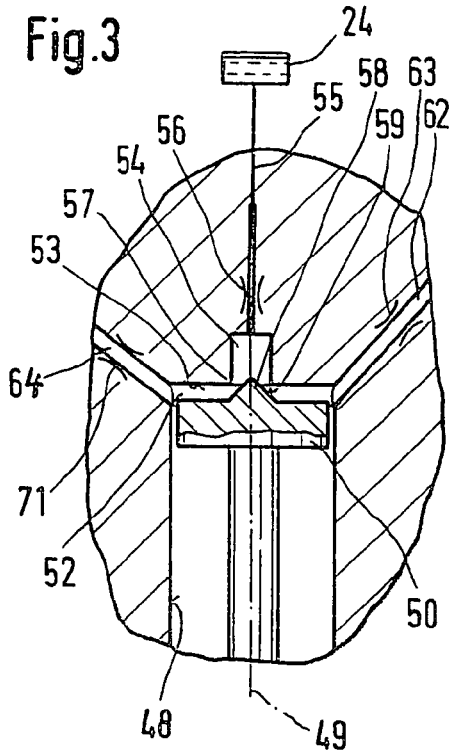
FIG. 3 shows the detail II when the injection valve element is in an open position.

FIGS. 2 and 3 show an enlarged detail II of the fuel injection system; FIG. 2 shows the control piston 50 when the injection valve element 28 is in its closed position and FIG. 3 shows the control piston when the injection valve element 28 is in the position in which it is opened by its maximal stroke. The conduit 62 that serves as a connection to the pump working chamber 22 and the conduit 64 that serves as a connection to the relief chamber 24 each feed into the control pressure chamber 52, viewed in the direction of its longitudinal axis 49, close to the edge of the control pressure chamber 52, for example on opposite sides from each other. In the boundary 53 of the control pressure chamber 52 at the opposite end from the control piston 50, viewed in the direction of its longitudinal axis 49, at least approximately coaxial to the control piston 50, a recess 54 is provided, which has a connection 55 to a relief chamber 24 leading from it and contains a throttle constriction 56. The cross section of the recess 54 is preferably circular and is provided with a seat 57 on the edge at which it transitions into the boundary 53. From the end surface of the control piston 50 that defines the control pressure chamber 52, a projection 58 protrudes coaxial to the recess 54, tapering toward the boundary 53 in the direction of the longitudinal axis 49 of the control piston 50, and is embodied, for example, in an at least approximately conical form. The projection 58 is provided with a sealing surface 59 that cooperates with the seat 57. Alternatively, however, it is also possible for the boundary 53 of the control pressure chamber 52 to be provided with a projection that protrudes into the control pressure chamber 52 and whose end has a seat embodied on it that cooperates with a sealing surface provided at the end of the control piston 50. When the injection valve element 28 according to FIG. 2 is in its closed position, then the control piston 50 is in its corresponding stroke position, with its sealing surface 59 spaced apart from the seat 57. When the second control valve 70 is closed, then high pressure prevails in the control pressure chamber 52 as well as in the pump working chamber 22, which acts on the entire surface area of the control piston 50 and correspondingly exerts a large force on the injection valve element 28 in the closing direction. When the injection valve element 28 according to FIG. 3 is in the position in which it is opened by its maximal stroke, then the projection 58 of the control piston 50 protrudes partially into the recess 54 and rests with its sealing surface 59 against the seat 57. The recess 54, as part of the control pressure chamber 52, and the part of the end surface of the control piston 50 disposed inside the seat 57 are then closed off from the rest of the control pressure chamber 52 and are pressure relieved in the direction of the relief chamber 24 via the connection 55 to the throttle restriction 56. The pressure prevailing in the rest of the control pressure chamber 52 then only acts on an annular part of the end surface of the control piston 50 encompassing the sealing surface 59 and the seat 57 so that a correspondingly weaker force is exerted on the injection valve element 28 in the closing direction. If it is necessary to open the fuel injection valve 12 starting from a closed position of the injection valve element 28, then the second control valve 70 must be opened in order to relieve the pressure in the control pressure chamber 52 since the pressure acts on the entire end surface of the control piston 50. If it is necessary to close the fuel injection valve 12 starting from a position of the injection valve element 28 in which it is opened by its maximal stroke, then if the second control valve 70 is closed, the first control valve 68 must be opened so that the pressure prevailing in the pressure chamber 40 and a pressure acting on the injection valve element 28 in the opening direction 29 falls below the sum of the force of the closing spring 44 and the force in the closing direction exerted by the pressure prevailing in the control pressure chamber 52.

Figure 4:
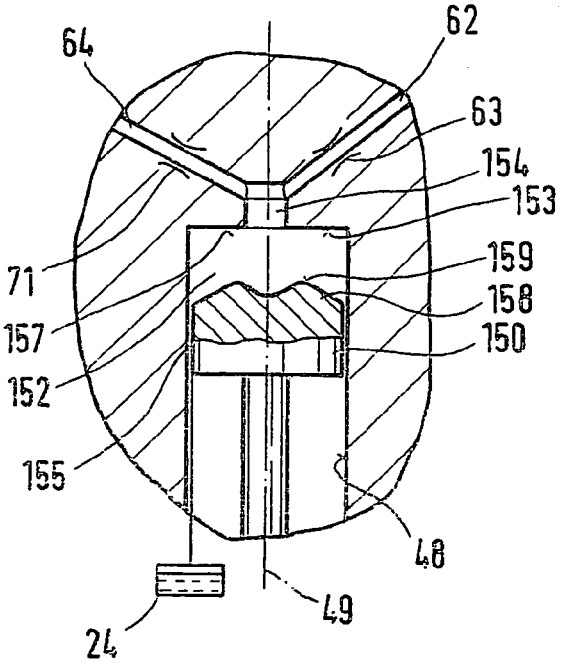
FIG. 4 shows the detail II of the fuel injection system according to a modified embodiment when the injection valve element is in a closed position.
Figure 5:
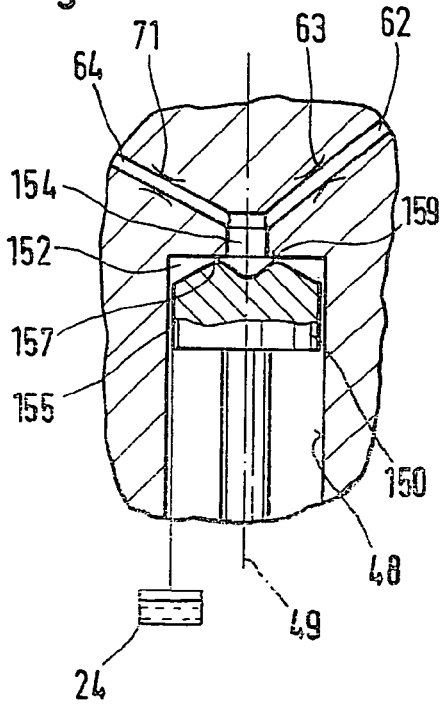
FIG. 5 shows the detail II according to the modified embodiment of the fuel injection system when the injection valve element is in an open position.

FIGS. 4 and 5 show the detail II of the fuel injection system according to a modified embodiment. The control pressure chamber 152 here has a diametrically reduced extension 154, which connects to both the conduit 62 that serves as a connection to the pump working chamber 22 and the conduit 64 that serves as a connection to the relief chamber 24. The extension 154 is situated at least approximately coaxial to the control piston 150. At the transition from the control pressure chamber 152 to the extension 154, the diametrical reduction forms an annular boundary 153 of the control pressure chamber 152. The boundary 153 extends laterally, for example at least approximately perpendicular to the longitudinal axis 49 of the control piston 150, is embodied as flat, and constitutes a flat seat 157. The end of the control piston 150 oriented toward the boundary 153 has an annular projection 158 protruding from it, with an annular sealing surface 159 at the end. When the injection valve element 28 is in its closed position and the control piston 150 is in the corresponding position according to FIG. 4, then the control piston 150 is disposed with its sealing surface 159 spaced apart from the seat 157 at the boundary 153 and the pressure prevailing in the control pressure chamber 152 acts on the entire end surface of the control piston 150. When the injection valve element 28 is in its open position and the control piston 150 is in the corresponding position according to FIG. 5, then the sealing surface 159 of the control piston 150 rests against the seat 157. The part of the control pressure chamber 152 disposed outside the sealing surface 159 is then closed off from the extension 154 so that the part 152 of the control pressure chamber is no longer connected to the pump working chamber 22. The part 152 of the control pressure chamber is thus pressure relieved and is connected to a relief chamber 24, for example by means of a gap 155 between the control piston 150 and the bore 48 that constitutes a throttle restriction or by means of a separate connection that contains a throttle restriction. The pressure prevailing in the extension 154 of the control pressure chamber then acts only on the part of the end surface of the control piston 150 inside the annular sealing surface 159.

The embodiment of the control piston 50 having the projection 58 with the conical sealing surface 59 according to FIGS. 2 and 3 can also be used in the embodiment according to FIGS. 4 and 5 instead of the annular projection 158 provided there. Likewise, the embodiment of the control piston 150 with the annular projection 158 and the annular sealing surface 159 according to FIGS. 4 and 5 can also be used in the embodiment according to FIGS. 2 and 3 instead of the projection 58 provided there. The essential difference between the embodiment according to FIGS. 2 and 3 and the embodiment according to FIGS. 4 and 5 is that in the embodiment according to FIGS. 2 and 3, when the injection valve element 28 is in its open position, the pressure prevailing in the control pressure chamber 52 acts on an annular part of the end surface of the control piston 50 surrounding the seat 57, while in the embodiment according to FIGS. 4 and 5, when the injection valve element 28 is in its open position, the pressure prevailing in the extension 154 of the control pressure chamber 52 acts on a part of the end surface of the control piston 150 disposed inside the seat 157.

Figure 6:
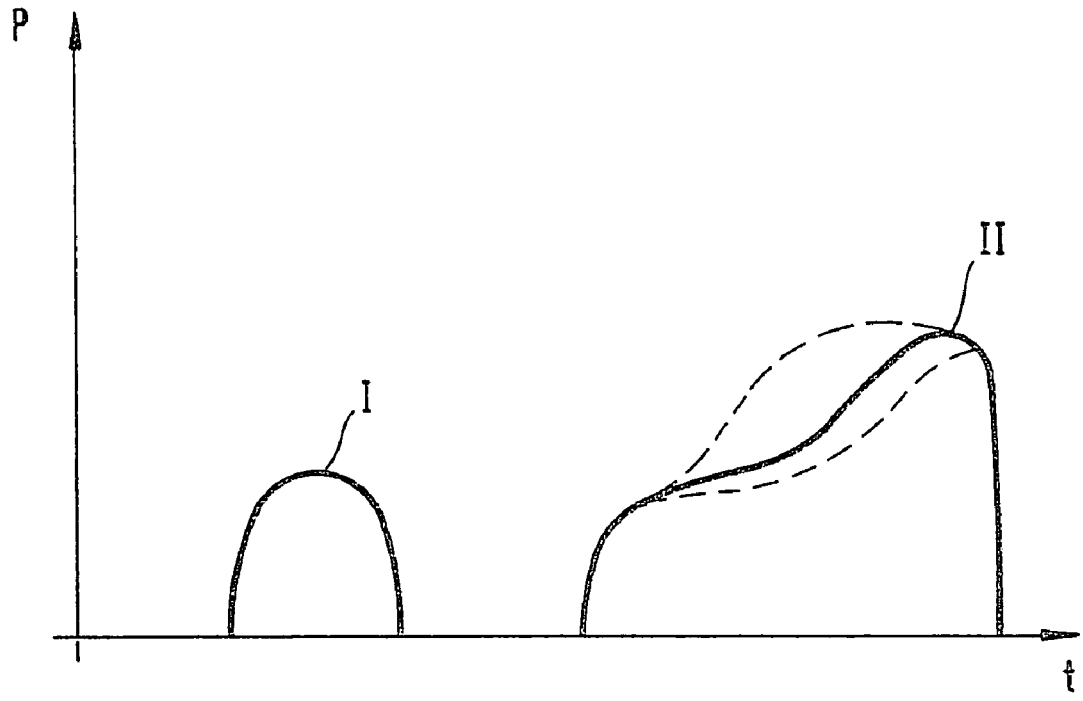
FIG. 6 shows a graph of the pressure at injection openings of a fuel injection valve of the fuel injection system.

The function of the fuel injection system will be explained below. FIG. 6 shows the graph of the pressure p at the injection openings 32 of the fuel injection valve 12 over time t during an injection cycle. During the intake stroke of the pump piston 18, it is supplied with fuel from the fuel tank 24. During the delivery stroke of the pump piston 18, the fuel injection begins with a preinjection, in which the control unit 72 closes the first control valve 68 so that the pump working chamber 22 is closed off from the relief chamber 24. The control unit 72 also opens the second control valve 70 so that the control pressure chamber 52 or 152 is connected to the relief chamber 24. In this instance, high pressure cannot build up in the control pressure chamber 52 or 152 since it is pressure relieved in the direction of the relief chamber 24. However, a small quantity of fuel can flow out of the pump working chamber 22 to the relief chamber 24 via the throttle restrictions 63 and 71 so that the entire high pressure that would build up if the second control valve 70 were closed cannot build up in the pump working chamber 22. If the pressure in the pump working chamber 22 and therefore in the pressure chamber 40 of the fuel injection valve 12 is great enough for the compressive force that it exerts on the injection valve element 28 via the pressure shoulder 42 to exceed the sum of the force of the closing spring 44 and the compressive force exerted on the control piston 50 or 150 by the residual pressure prevailing in the control pressure chamber 52 or 152, then the injection valve element 28 moves in the opening direction 29 and unblocks the at least one injection opening 32. The injection valve element 28 then only opens with a partial stroke so that the sealing surface 59 or 159 of the control piston 50 or 150 does not come into contact with the seat 57 or 157. Only a relatively low pressure acts on the end surface of the injection valve element 28 in the opening direction 29 and the pressure prevailing in the control pressure chamber 52 or 152 acts on the entire end surface of the control piston 50 or 150. In order to terminate the preinjection, the control unit closes the second control valve 70 so that the control pressure chamber 52 or 152 is closed off from the relief chamber 24. The first control valve 68 remains in its closed position. As a result, the same high pressure as in the pump working chamber 22 builds up in the control pressure chamber 52 or 152 so that a powerful compressive force acts on the control piston 50 or 150 in the closing direction. The fact that as a result of the partial stroke of the injection valve element 28, only a slight force is exerted on the injection valve element 28 in the opening direction 29, which is less than the sum of the force of the closing spring 44 and the force of the pressure acting on the control piston 50 or 150, causes the fuel injection valve 12 to close. The preinjection corresponds to an injection phase labeled I in FIG. 6.

For a subsequent main injection that corresponds to the injection phase labeled II in FIG. 6, the control unit 72 opens the second control valve 70. The fuel injection valve 12 then opens due to the reduced compressive force on the control piston 50 or 150 and the injection valve element 28 moves for its maximal opening stroke until the sealing surface 59 or 159 of the control piston 50 or 150 comes into contact with the seat 57 or 157. The seat 57 or 157 consequently also constitutes a stop for limiting the stroke of the control piston 50 or 150 and therefore the opening stroke motion of the injection valve element 28. If the injection valve element 28 is opened by its maximal opening stroke, then the control unit 72 can close the second control valve 70 so that the control pressure chamber 52 or 152 is closed off from the relief chamber 24. Then the same high pressure as in the pump working chamber 22 does in fact build up in the control pressure chamber 52 or 152, but due to the small end surface of the control piston 50 or 150 that is actually subjected to pressure, the force in the closing direction, which is the sum of the force of the pressure acting on the control piston 50 or 150 and the force of the closing spring 44, is less than the force in the opening direction 29 generated by the force on the pressure shoulder 42 and the end surface of the injection valve element that is open by its maximal stroke, thus causing the fuel injection valve 12 to remain open. As long as the second control valve 70 remains open, the fuel injection occurs at a reduced pressure since a small fuel quantity flows out of the pump working chamber 22 and into the relief chamber 24 via the open control valve 70. When the second control valve 70 is closed, then no more fuel can flow out of the pump working chamber 22 and the fuel injection occurs at a higher pressure, as indicated in FIG. 6. The time at which the control unit 72 closes the second control valve 70 preferably varies as a function of operating parameters of the internal combustion engine, in particular as a function of the engine speed. It is possible for the control unit 72 to close the second control valve 70 at an earlier time when engine speeds are low and for the control unit 72 to close the second control valve 70 at a later time as engine speeds increase. This allows limits to be placed on the maximal pressure of the fuel injection at high engine speeds.

In order to terminate the main injection, the control unit 72 brings the first control valve 68 into its open switched position so that the pump working chamber 22 communicates with the relief chamber 24 and only a slight pressure-induced force acts on the injection valve element 28 in the opening direction 29; the fuel injection valve 12 closes due to the force of the closing spring 44 and the force exerted by the residual pressure in the control pressure chamber 52 or 152, which once again acts on the entire end surface of the control piston 50 or 150 after the sealing surface 59 or 159 of the control piston 50 or 150 lifts up from the seat 57 or 157. The second control valve 70 can be in either its open position or its closed position upon termination of the main injection.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for an internal combustion engine, having a high-pressure fuel pump (10) with a fuel injection valve (12) connected to it for each cylinder of the engine, wherein the high-pressure fuel pump (10) has a pump piston (18) that is driven into a stroke motion by the engine and defines a pump working chamber (22) that is supplied with fuel from a fuel tank (24), wherein the fuel injection valve (12) has a pressure chamber (40) connected to the pump working chamber (22) and an injection valve element (28) that controls at least one injection opening (32) and the pressure prevailing in the pressure chamber (40) can act on the injection valve element (28) in an opening direction (29) in order to open the at least one injection opening (32), having a first control valve (68) that controls a connection (66) of the pump working chamber (22) to a relief chamber (24), and having a second control valve (70) that controls a connection (64) of a control pressure chamber (52, 54; 152, 154) to a relief chamber (24), wherein the control pressure chamber (52, 54; 152, 154) is defined by a control piston (50; 150), which, when acted on by the pressure prevailing in the control pressure chamber (52, 54; 152, 154), acts in a closing direction on the injection valve element (28) and can move together with the injection valve element (28), wherein the control pressure chamber (52, 54; 152, 154) has a connection (62) to the pump working chamber (22), the improvement wherein, in a stroke position of the control piston (50; 150) in which the injection valve element (28) is in its closed position, the pressure prevailing in the control pressure chamber (52, 54; 152, 154) acts on a greater end surface of the control piston (50; 150) than in a stroke position of the control piston (50; 150) in which the injection valve element (28) is opened by its maximal stroke.

2. The fuel injection system according to claim 1, wherein in the stroke position of the control piston (50; 150) in which the injection valve element (28) is opened by its maximal stroke, a part (54; 152) of the control pressure chamber is closed off from the rest of the control pressure chamber (54; 152) so that pressure acts on only that part of the end surface of the control piston (50; 150) that borders the remaining control pressure chamber (52; 154).

3. The fuel injection system according to claim 1, wherein when the injection valve element (28) is in the position in which it is opened by its maximal stroke, the control piston (50; 150) comes into contact with a seat (57; 157), as a result of which the part of the control pressure chamber (54; 152) is closed off from the rest of the control pressure chamber (52; 154).

4. The fuel injection system according to claim 2, wherein when the injection valve element (28) is in the position in which it is opened by its maximal stroke, the control piston (50; 150) comes into contact with a seat (57; 157), as a result of which the part of the control pressure chamber (54; 152) is closed off from the rest of the control pressure chamber (52; 154).

5. The fuel injection system according to claim 3, wherein the end of the control piston (50; 150) comprises a projection (58; 158) with a sealing surface (59; 159) with which the control piston (50; 150) comes into contact with a seat (57; 157) disposed at a boundary (53; 153) of the control pressure chamber (52; 152) at the opposite end from the control piston, and wherein when the sealing surface (59; 159) of the control piston (50; 150) rests against the seat (57; 157), it closes off the part of the control pressure chamber (54; 152) from the remaining control pressure chamber (52; 154).

6. The fuel injection system according to claim 4, wherein the end of the control piston (50; 150) comprises a projection (58; 158) with a sealing surface (59; 159) with which the control piston (50; 150) comes into contact with a seat (57; 157) disposed at a boundary (53; 153) of the control pressure chamber (52; 152) at the opposite end from the control piston, and wherein when the sealing surface (59; 159) of the control piston (50; 150) rests against the seat (57; 157), it closes off the part of the control pressure chamber (54; 152) from the remaining control pressure chamber (52; 154).

7. The fuel injection system according to claim 5, wherein the connections (62, 64) of the control pressure chamber (52, 54) to the pump working chamber (22) and the relief chamber (24) feed into the control pressure chamber (52, 54) outside of the seat (57) so that when the sealing surface (59) of the control piston (50) rests against the seat (57), the part (54) of the control pressure chamber inside the sealing surface (59) is closed off from the connections (62, 64) and the pressure prevailing in the remaining control pressure chamber (52) acts on only an annular part of the end surface of the control piston (50) encompassing the sealing surface (59).

8. The fuel injection system according to claim 6, wherein the connections (62, 64) of the control pressure chamber (52, 54) to the pump working chamber (22) and the relief chamber (24) feed into the control pressure chamber (52, 54) outside of the seat (57) so that when the sealing surface (59) of the control piston (50) rests against the seat (57), the part (54) of the control pressure chamber inside the sealing surface (59) is closed off from the connections (62, 64) and the pressure prevailing in the remaining control pressure chamber (52) acts on only an annular part of the end surface of the control piston (50) encompassing the sealing surface (59).

9. The fuel injection system according to claim 7, wherein, inside the seat (57), an additional connection (55) leads from the control pressure chamber (52, 54) to a relief chamber (24) and preferably contains a throttle restriction (56) and serves to relieve the pressure on the part (54) of the control pressure chamber inside the sealing surface (59) when the sealing surface (59) of the control piston (50) is resting against the seat (57).

10. The fuel injection system according to claim 8, wherein, inside the seat (57), an additional connection (55) leads from the control pressure chamber (52, 54) to a relief chamber (24) and preferably contains a throttle restriction (56) and serves to relieve the pressure on the part (54) of the control pressure chamber inside the sealing surface (59) when the sealing surface (59) of the control piston (50) is resting against the seat (57).

11. The fuel injection system according to claim 5, wherein the connections (62, 64) of the control pressure chamber (152, 154) to the pump working chamber (22) and the relief chamber (24) feed into the control pressure chamber (152, 154) inside the seat (157) so that when the sealing surface (159) of the control piston (150) is resting against the seat (157), the part (152) of the control pressure chamber surrounding the sealing surface (159) is closed off from the connections (62, 64) and the pressure prevailing in the rest of the control pressure chamber (154) acts on only a part of the end surface of the control piston (150) disposed inside the sealing surface (159).

12. The fuel injection system according to claim 6, wherein the connections (62, 64) of the control pressure chamber (152, 154) to the pump working chamber (22) and the relief chamber (24) feed into the control pressure chamber (152, 154) inside the seat (157) so that when the sealing surface (159) of the control piston (150) is resting against the seat (157), the part (152) of the control pressure chamber surrounding the sealing surface (159) is closed off from the connections (62, 64) and the pressure prevailing in the rest of the control pressure chamber (154) acts on only a part of the end surface of the control piston (150) disposed inside the sealing surface (159).

13. The fuel injection system according to claim 11, wherein the rest of the control pressure chamber (152) is connected to a relief chamber (24) and this connection (155) preferably contains a throttle restriction.

14. The fuel injection system according to claim 12, wherein the rest of the control pressure chamber (152) is connected to a relief chamber (24) and this connection (155) preferably contains a throttle restriction.

15. The fuel injection system according to claim 7, wherein the boundary (53) of the control pressure chamber (52) contains a recess (54), which is part of the control pressure chamber, the projection (58) of the control piston (50) protrudes into the recess, and the seat (57) is provided at the edge of the recess.

16. The fuel injection system according to claim 9, wherein the boundary (53) of the control pressure chamber (52) contains a recess (54), which is part of the control pressure chamber, the projection (58) of the control piston (50) protrudes into the recess, and the seat (57) is provided at the edge of the recess.

17. The fuel injection system according to claim 11, wherein the boundary (53) of the control pressure chamber (52) contains a recess (54), which is part of the control pressure chamber, the projection (58) of the control piston (50) protrudes into the recess, and the seat (57) is provided at the edge of the recess.

18. The fuel injection system according to claim 7, wherein the seat (157) which is provided at the boundary (153) of the control pressure chamber (152) and extending lateral to the longitudinal axis (49) of the control piston (150) comprises a flat seat (157).

19. The fuel injection system according to claim 9, wherein the seat (157) which is provided at the boundary (153) of the control pressure chamber (152) and extending lateral to the longitudinal axis (49) of the control piston (150) comprises a flat seat (157).

20. The fuel injection system according to claim 11, wherein the seat (157) which is provided at the boundary (153) of the control pressure chamber (152) and extending lateral to the longitudinal axis (49) of the control piston (150) comprises a flat seat (157).

* * * * *